US007059356B2

(12) United States Patent
Mettler

(10) Patent No.: US 7,059,356 B2
(45) Date of Patent: Jun. 13, 2006

(54) SHED-FORMING DEVICE FOR A POWER LOOM

(75) Inventor: Franz Mettler, Wollerau (CH)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/053,347

(22) Filed: Feb. 9, 2005

(65) Prior Publication Data

US 2005/0183788 A1 Aug. 25, 2005

(30) Foreign Application Priority Data

Feb. 10, 2004 (DE) ..... 10 2004 006 389

(51) Int. Cl.
*D03C 13/00* (2006.01)

(52) U.S. Cl. ..... 139/55.1; 139/455; 139/76; 139/82

(58) Field of Classification Search ..... 139/55.1, 139/57, 455, 76, 82
See application file for complete search history.

(56) References Cited

U.S. PATENT DOCUMENTS

| | | | | |
|---|---|---|---|---|
| 1,845,715 | A * | 2/1932 | Keys | 139/35 |
| 3,557,842 | A * | 1/1971 | Porter | 139/55.1 |
| 4,071,053 | A * | 1/1978 | Santucci et al. | 139/436 |
| 4,460,020 | A * | 7/1984 | Juillard | 139/82 |
| 4,603,713 | A * | 8/1986 | Takada | 139/82 |
| 4,877,060 | A * | 10/1989 | Froment et al. | 139/82 |
| 4,905,738 | A * | 3/1990 | Kleiner | 139/76 |
| 5,069,256 | A * | 12/1991 | Goodman, Jr. | 139/83 |
| 5,082,029 | A * | 1/1992 | Dornier | 139/1 E |
| 5,305,801 | A * | 4/1994 | Rupflin et al. | 139/91 |
| 5,645,111 | A * | 7/1997 | Lindblom | 139/55.1 |
| 5,653,268 | A * | 8/1997 | Burkert | 139/79 |
| 5,740,840 | A * | 4/1998 | Lindahl | 139/55.1 |
| 5,944,061 | A * | 8/1999 | Eriksson | 139/66 R |
| 6,460,577 | B1 | 10/2002 | Krumm | |

FOREIGN PATENT DOCUMENTS

| | | |
|---|---|---|
| DE | 198 21 094 A1 | 7/1999 |
| DE | 101 11 017 A1 | 10/2002 |
| EP | 0 879 909 A1 | 11/1998 |
| EP | 1 215 317 A2 | 6/2002 |
| JP | 200389940 A | 10/2004 |

* cited by examiner

*Primary Examiner*—John J. Calvert
*Assistant Examiner*—Robert H Muromoto
(74) *Attorney, Agent, or Firm*—Fitch, Even, Tabin & Flannery; Norman N. Kunitz

(57) ABSTRACT

A shed forming device (1) for a power loom has a plurality of heddle shafts, to which a drive mechanism with a plurality of servo motor groups (13, 14) is assigned. The servo motor groups are located below each of the heddle shafts (3 through 8), in each case as a cluster, and they are located with their pivot axes (27 through 32) on a circle, an ellipse, or a similar figure. They are also axially offset from one another. Each servo motor (15 through 20) is provided with a driven lever (21 through 26). The free ends of all the levers are located approximately at the center of the circle or ellipse or other figure of revolution. They are connected to the heddle shafts (3 through 8) via connecting rods (34 through 39) and form various angles with the connecting rods (34 through 39). The result is a drive mechanism with little inertia, low resilience, and little play. Very fast shaft motions can be attained in a controlled way.

22 Claims, 6 Drawing Sheets

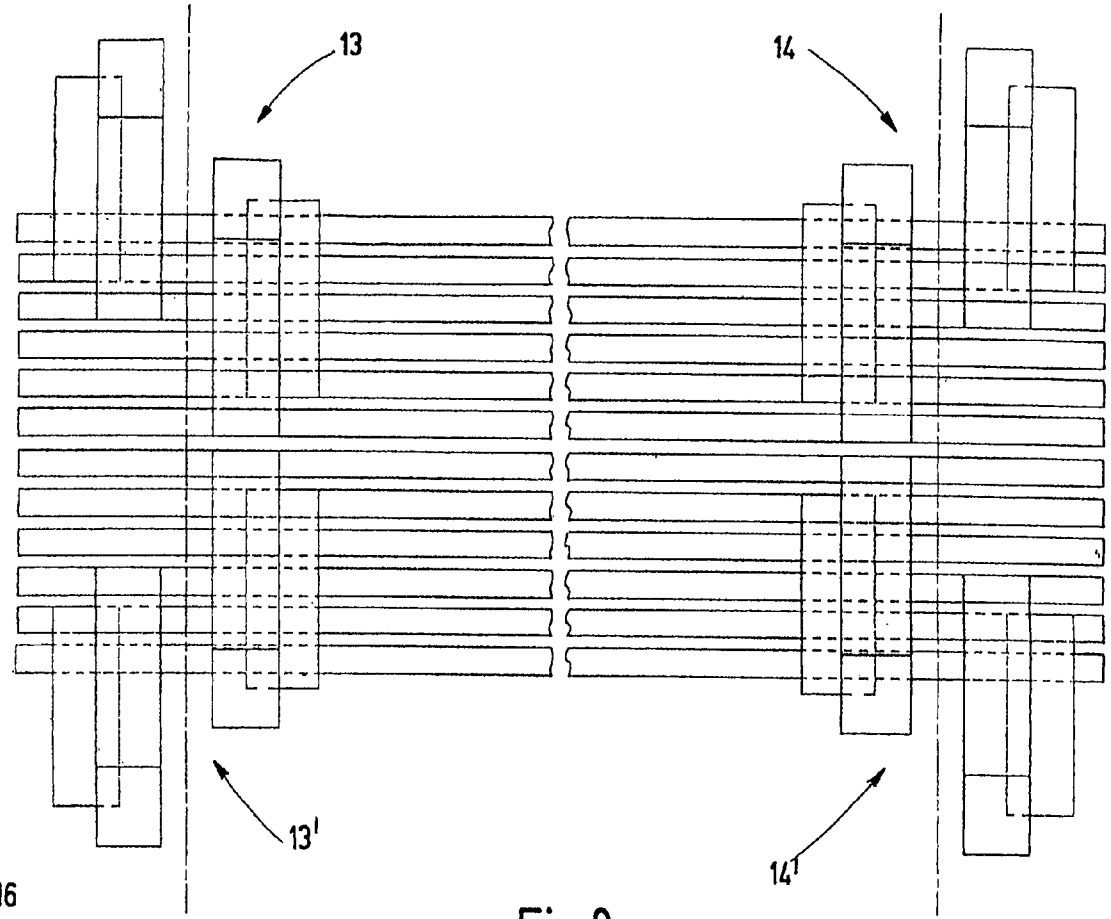
Fig.8
Fig.7
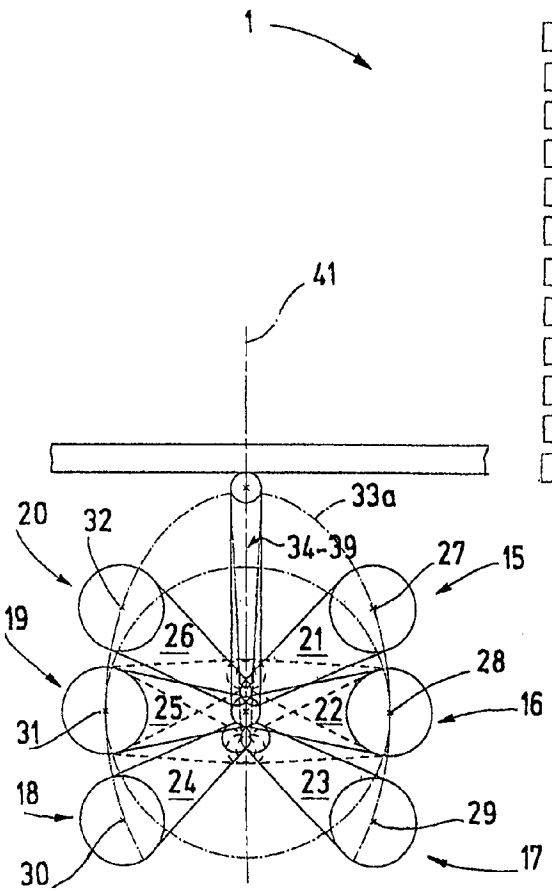

SHED-FORMING DEVICE FOR A POWER LOOM

CROSS REFERENCE TO RELATED APPLICATION

This application claims the priority of German Patent Application No. 10 2004 006 389.3, filed on Feb. 10, 2004, the subject matter of which, in its entirety, is incorporated herein by reference.

FIELD OF THE INVENTION

The invention relates to a shed forming device for a power loom.

BACKGROUND OF THE INVENTION

Power looms have a so-called shed forming device, which serves to guide warp yarns outward and upward or downward from the warp yarn plane in accordance with a binding pattern, so that the spread-apart warp yarns create what is known as a shed. A weft yarn is introduced into this shed (weft insertion). Shedding can be done for instance by means of so-called heddles, with one warp yarn passing through the eye of each heddle. The heddles are held on a frame that is called a heddle shaft. The heddle shaft must be moved up and down in rapid succession in accordance with the pace of operation of the power loom. As a rule, modern power looms have a plurality of heddle shafts, which are located close together and in line with one another. The various shafts are assigned to different warp yarns. Depending on which shafts are guided upward or downward, different sheds can be formed in order to generate the desired weave structure (weave pattern) between the warp yarns and weft yarns. For driving the shafts, as a rule so-called shaft machines are used, which derive the shaft motion from the main drive of the power loom by suitable gear means.

Moving the shafts individually by means of suitable servo drives has already been proposed multiple times. For instance, German Patent Disclosure DE 198 21 094 A1 discloses an electromagnetic drive for the purpose. In one embodiment, the shaft is connected to two electromagnetic drive mechanisms, which act as linear drives. Tension and presser bars connect the movable member of the electromagnetic drive to the shaft. The electromagnetic linear drives are located below the shaft.

From the same reference, it is known to locate the electromagnetic linear drive next to the shaft, and to convert the horizontal working motion of the drive into the vertical working motion of the shaft via a suitable gear.

This principle meets limits if a plurality of shafts must be located close together and correspondingly driven. Typically, the shafts are at a spacing of 12 mm. The space available for the electromagnetic linear drives is thus extremely restricted, so that practical solutions to the problem are hardly achievable.

From Japanese Patent Disclosure JP 2003-89940 A, it is known to drive heddle shafts of a power loom by means of servo motors. To that end, one servo motor is assigned to each heddle shaft. The servo motors are located in two planes one above the other in a drive chest located correspondingly laterally next to the power loom. Each servo motor actuates one connecting rod via a cam. Angle levers located below the heddle shafts deflect the approximately horizontally oscillating connecting rod motion into a vertical oscillation. The two angle levers are joined together by a tension and compression rod.

A similar arrangement is known from European Patent Disclosure EP 1 215 317 A2. However, this reference also discloses the disposition of servo motors in more than two levels one above the other; the servo motors may be offset from one another or vertically flush with one another.

In the drive mechanisms of the last two references named, difficulties and limitations can arise in terms of the operating speed, because of the inherently inertial masses of the gear elements and from bearing plays.

European Patent Disclosure EP 0 879 909 A1 proposes for this purpose that the heddle shafts be moved by means of linear direct drives or electric linear motors. Because of the close spacing of the heddle shafts, or the slight distance between them, this runs up against the same problems in terms of accommodating the linear drives.

German Patent Disclosure DE 101 11 017 A1 seeks to overcome these disadvantages with special electric motors constructed in disklike fashion, whose rotor forms a long lever. The lever is connected to the heddle shaft via a connecting rod. The special motors can be placed in pairs, diametrically opposite one another, and can also be placed in a plurality of planes. As a result, twice or four times the axial heddle shaft thickness is available for the axial structural length of the motors. Nevertheless, in this concept, the axial length of the motors is limited. Moreover, at least if the motors are located in different planes, different connecting rods are different lengths, which again can cause problems.

Against this background, it is the object of the invention to create a shed forming device which is improved in terms of the embodiment of its drive mechanism.

SUMMARY OF THE INVENTION

The shed forming device of the invention has a plurality of heddle shafts, each of which is assigned individual drive mechanisms. The drive mechanisms each form a cluster that is located below the group of heddle shafts. Each drive mechanism includes at least one servo motor, with a lever that is secured to its driven shaft and that is connected to the heddle shaft via a connecting rod. It is provided that the levers of the servo motors are oriented in different directions in space, when the heddle shafts are in the position of repose. This provision makes it possible to place the servo motors next to and one above the other in a plurality of planes, without requiring complicated intermediate gears for converting the rotary motion of the servo motor into a linear motion of the heddle shaft. Servo motors of a virtually arbitrary structural length can be employed, even if there is a high number of heddle shafts, such as 12 or 16 of them. This in turn opens the way to relatively slender servo motors, whose outer diameter is less than the length of the lever that they actuate. Slender servo motors have a very low intrinsic moment of inertia as a rule, which makes it possible to achieve high shaft accelerations. Moreover, because there is no limitation on their length, the servo motors can have a great length that is suitable for attaining the requisite driving torque.

The provision of having the levers, secured to the servo motors and moved by them, point in different directions in space in the position of repose opens the way to an overall compact construction. The free pivoting ends of the levers are all located in the center of the cluster defined by the servo motors, or in other words the applicable group of servo motors. Thus the heddle shafts can be connected to the levers with substantially uniform connecting rods. The spacing between the heddle shafts and the group of servo motors can be relatively slight, and nevertheless great connecting rod lengths are attained. The levers of the upper servo motors in a group of servo motors point downward toward the lower connecting rod ends, while the levers of the lower servo motors of a group of servo motors point upward toward the connecting rods. The ends of the driven levers are all approximately in the same central region, surrounded by the group of servo motors. This is where the lower connecting rods also end. The servo motors of the group of servo motors thus utilize both the region in space available above the lower connecting rod ends and the available region in space below it for locating the servo motors. This leads to a compact space-saving design and a short force transmission path. The gear present between the servo motors and the heddle shafts can be designed as light in weight and low in play, which is favorable for both increasing the operating speed and for prolonging the service life.

The axes of the servo motors are preferably located on a circle or an ellipse. This makes for a simple arrangement and somewhat symmetrical drive conditions for different servo motors of the same group.

The servo motors are preferably connected to a control unit, which carries a control signal accordingly to the heddle shafts. In an extremely simple case, the control signal is a switching signal. It instructs the applicable servo motor to transfer the heddle shaft assigned to it to the upper or lower terminal position of that heddle shaft. In this mode of operation, the nonlinear gear ratio that the connecting rod and the lever form plays a subordinate role. However, it is also possible to guide the shaft proportionally to a control signal. In that case, the control unit preferably has a block of characteristic curves, which compensates for the nonlinear characteristic curve of the lever gear ratio. The different servo motors can each be assigned individual blocks of characteristic curves. From the standpoint of the control unit, the result is thus a linear drive, in which each shaft obeys its control signal proportionally.

Further details of advantageous embodiments of the invention are the subject of the drawing, the description, or claims.

BRIEF DESCRIPTION OF THE DRAWINGS

In the drawing, exemplary embodiments of the invention are illustrated. Shown are:

FIG. 7, a fragmentary front view of a further modified embodiment of a shed forming device;

FIG. 8, a top view of the shed forming device of FIG. 7; and

DETAILED DESCRIPTION OF THE INVENTION

Figure 1:
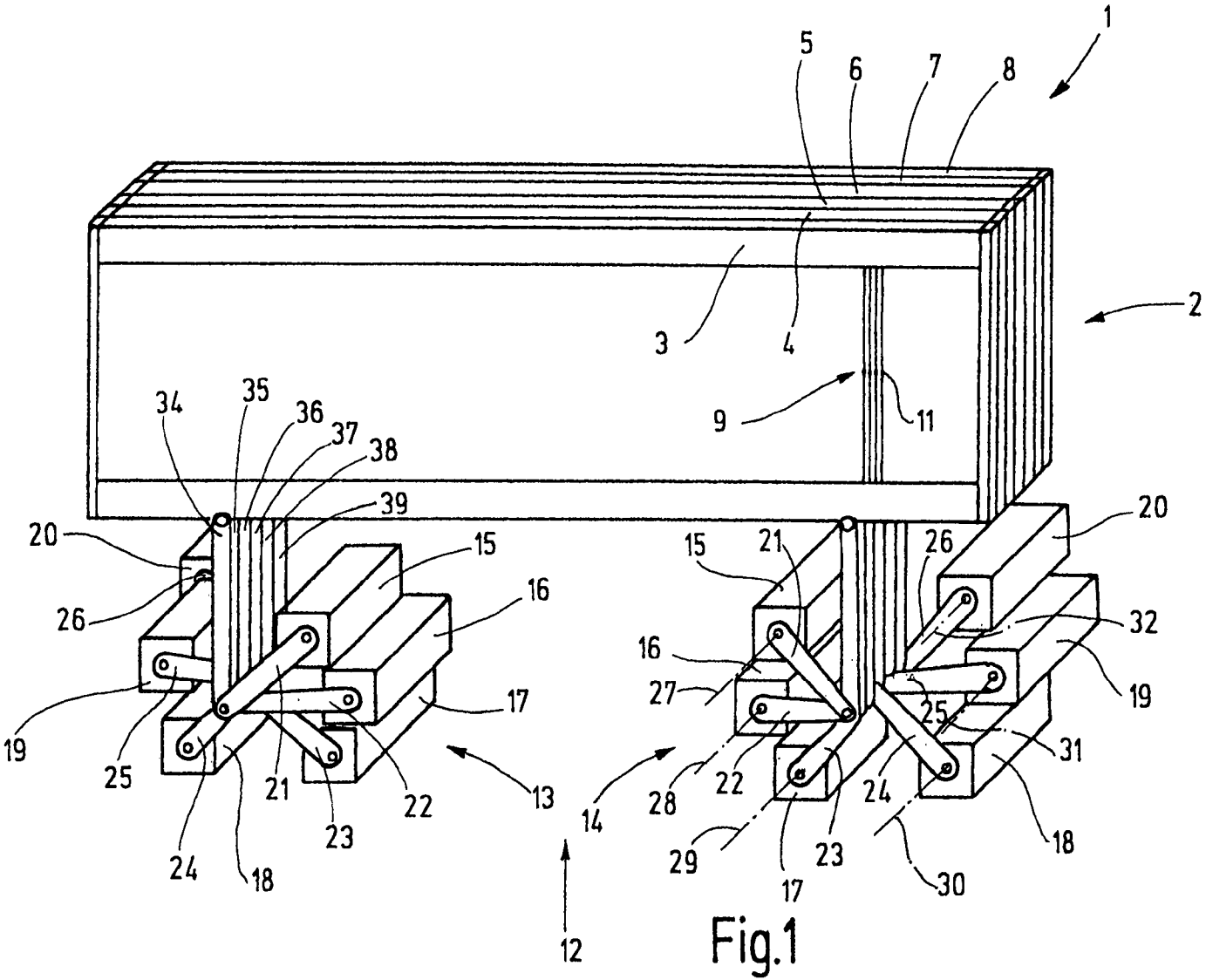
FIG. 1, a schematic perspective view of a shed forming device of the invention.

In FIG. 1, a shed forming device 1 is shown, to which twelve heddle shafts 2 belong. Of these, six heddle shafts 3 through 8 are shown in FIG. 1. The heddle shafts 2 are each formed by a rectangular frame with an upper and a lower, typically horizontally located, shaft rod. The ends of the shaft rods are joined together by so-called side struts. The heddle shafts 2 serve to guide and support heddles 9, whose ends are seated on heddle slide bars that are not shown further. The heddles 9 are low, flexible metal elements, each with at least one yarn eyelet 11 for guiding the warp yarn. The heddles 9 are preferably seated with some longitudinal play (vertical play) on the corresponding heddle slide bars. If a heddle shaft 3 through 8 is guided upward or downward (that is, is adjusted in the longitudinal direction of the heddles) while the other heddle shafts remain in the same place, a shed is created, into which a weft yarn can be inserted (weft insertion).

The heddle shafts 2 are embodied as relatively flat, in terms of the longitudinal direction of the warp yarn. Typically, each of them takes up hardly more than 12 mm, so that a correspondingly close-together arrangement of heddle shafts 3 through 8 can be seen. Nevertheless, they must be capable of being moved individually, that is, independently of one another, upward or downward as fast as possible. To that end, the drive mechanism 12 shown schematically in FIG. 1 is used, which includes two or more servo motor groups 13, 14. The servo motor groups 13, 14, in this exemplary embodiment, are embodied as mirror images of one another. The ensuing description of the servo motor group 14 thus applies accordingly to the servo motor group 13. The reference numerals introduced in the context of describing the servo motor group 14 are accordingly repeated in FIG. 1 for the servo motor group 13. The description of the servo motor group 14 applies correspondingly to the servo motor group 13, taking the mirror-inverted arrangement into account.

The servo motor group 14 includes six servo motors 15 through 20, which each carry a respective lever 21 through 26. The lever is connected in a manner fixed against relative rotation to a driven shaft of the respective servo motor 15 through 20 that defines a pivot axis 27 through 32. As can be seen particularly from FIG. 2 taking the servo motor group 13 as an example, the servo motors are located such that their pivot axes 27 through 32 are located on an imaginary circle 33. With their free ends, the levers 21 through 26 point toward the center of this circle 33. Thus with respect to the circle 33, the levers 21 through 26 are oriented essentially radially. At least, they are oriented in such a way that the end of a given lever 21 through 26 can reach the center of the circle 33 in the course of its working motion.

Figure 3:
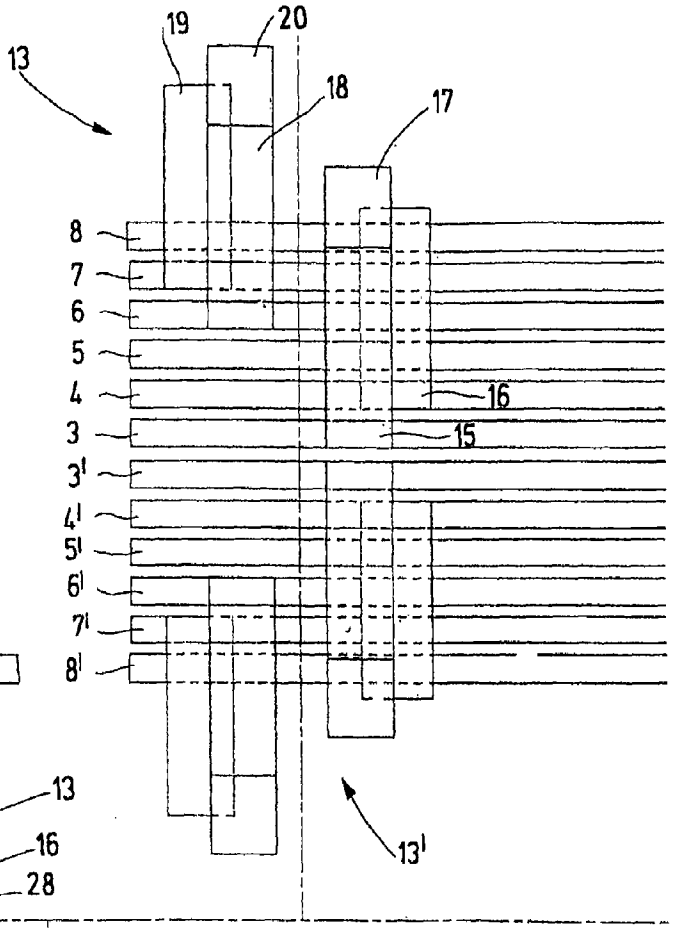
FIG. 3, a fragmentary schematic top view of the shed forming device of FIGS. 1 and 2.

The servo motors 15 through 20, as FIGS. 1 and 3 show, are offset axially from one another, so that with respect to the longitudinal direction of the axes 27 through 32, the ends of the levers 21 through 26 are staggered longitudinally one behind the other. The longitudinal offset of the servo motors 15 through 20 corresponds to the spacing defined by the heddle shafts 3 through 8. The servo motor 15 is located such that its lever 21 is below the heddle shaft 3. The servo motor 16 is located such that its lever 22 is located below the heddle shaft 4. The further servo motors 17 through 20 are correspondingly offset in such a way that finally the lever 26 of the servo motor 20 is located below the heddle shaft 8.

The free ends of the levers 21 through 26 are each connected in an articulated fashion to one end of a connecting rod 34 through 39, whose respective upper end is connected in articulated fashion with the associated heddle shaft 3 through 8. The connecting rods 34 through 39 are preferably essentially of equal length and are parallel to one another. The connection between the servo motors 15 through 20 and the respectively assigned heddle shaft 3 through 8 is thus attained by way of merely two articulation points, namely one between the heddle shaft and the connecting rod, and a second one between the connecting rod and the associated lever. Such a connection is low in play and moreover has only slight inertial masses. The axes 27 through 32 of the servo motors are preferably distributed over the circle 33 in the way shown in FIG. 2. The axes 28, 31 are diametrically opposite one another in mirror-inverted fashion with respect to a vertical line 41 defined by the connecting rod 34. At the least possible angular spacing above the servo motors 16, 17, the servo motors 15; 20 are diametrically opposite one another in mirror-inverted fashion (except for the axial offset). The same is correspondingly true for their pivot axes 27, 32. The pivot axes 28, 31 define a horizontal line 42. With respect to this horizontal line, the servo motors 17, 18 and their axes 29, 30 are located in mirror-inverted fashion to the servo motors 15, 20 and their axes 27, 32. Given this arrangement, the levers 21, 26 each form an acute angle, for instance of approximately 45?, with the associated connecting rods 34, 39. In the position of repose, the levers 22, 25 each form a right angle with the associated connecting rods 35, 38. The levers 23, 24 each form an obtuse angle, for instance of 135?, with the associated connecting rods 36, 37. The levers 21 through 26 are preferably approximately of equal length. They extend in a star pattern away from the center of the circle 33. The pivot axes 30, 31, 32 define an isosceles triangle. The same is true for the mirror-inverted pivot axes 27, 28, 29.

As FIG. 3 shows, the complete shaft arrangement includes a second group of heddle shafts 3' through 8', which in turn is driven by a servo motor group 13'. The servo motor group 13' and the heddle shafts 3' through 8' are arranged as a mirror image of the above-described group of heddle shafts 3 through 8 and the servo motor group 13 in terms of a vertical plane. In FIG. 3, the vertical plane is perpendicular to the plane of the drawing and extends parallel to the heddle shafts 3 through 8. Accordingly, the description of the servo motor group 13 applies to the servo motor group 13' as well. The description of the heddle shafts 3 through 8 applies correspondingly to the heddle shafts 3' through 8'. The servo motor group 14 likewise has a mirror-inverted counterpart servo motor group, but it is not further shown. Thus the heddle shafts 3 through 8 and 3' through 8' are located by a total of four servo motor groups that include a total of 24 servo motors.

Figure 4:
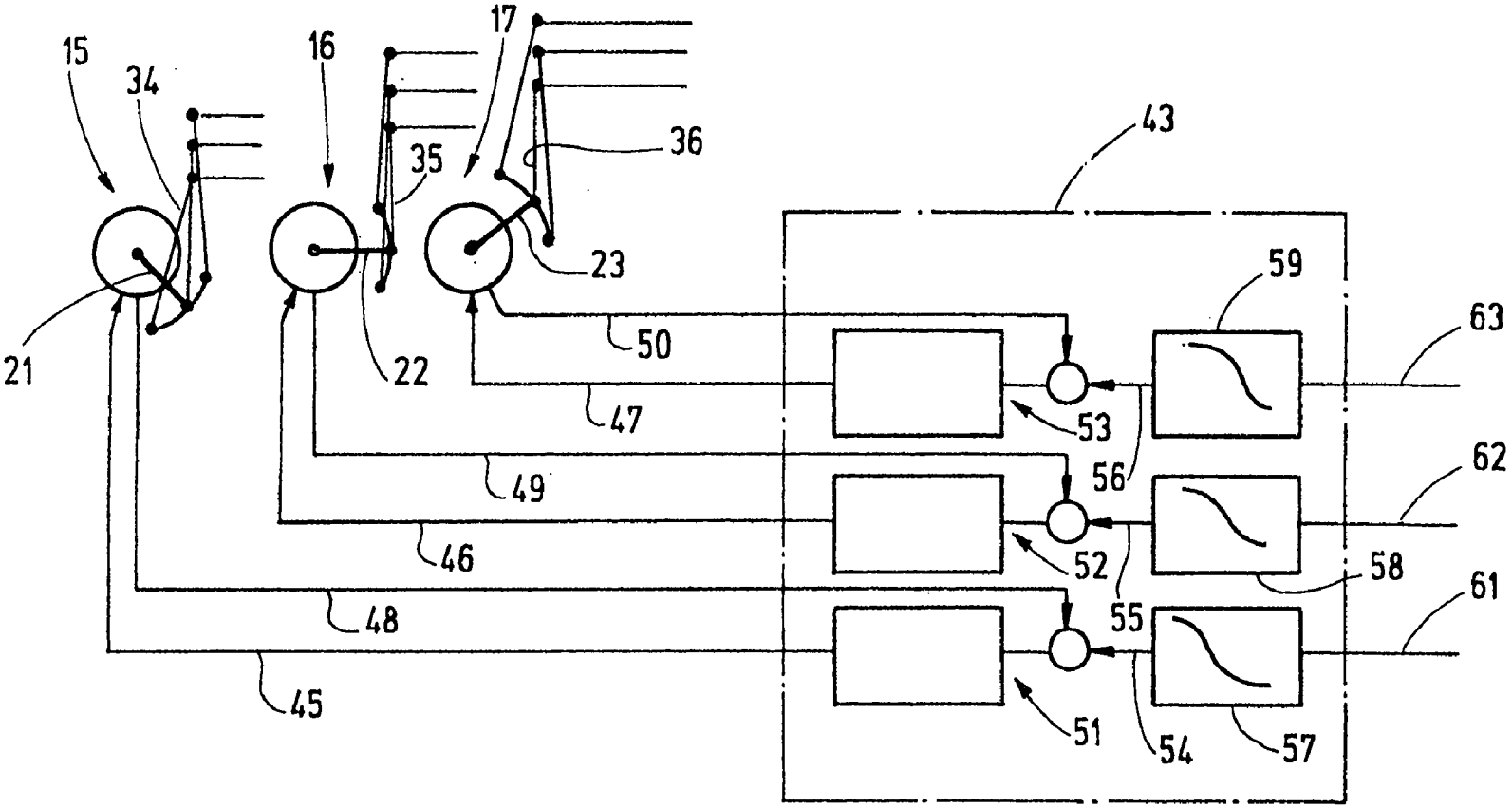
FIG. 4, a schematic functional illustration of the shed forming device and its control unit.

FIG. 4 shows the triggering of the servo motors 15, 16, 17 by a control unit 43. This control unit is shown merely as an example for the servo motors 15 through 17. It has corresponding inputs and outputs for all the other servo motors as well. The servo motors 15 through 17 stand as representatives of them; the servo motor 15 is typical for all the other servo motors whose lever forms an acute angle with the connecting rod in the position of repose. The servo motor 16 is typical for all the servo motors whose lever forms approximately a right angle with the associated connecting rods in the position of repose. The servo motor 17 is typical for all the servo motors whose lever forms an obtuse angle with the associated connecting rod in the position of repose.

All the servo motors 15 through 17 each have a control input, which is supplied with control power by the control unit 43 via a suitable line or bundle of lines 45 through 47. This power may be in the form of control voltage, control currents, and/or suitable control pulses. Each servo motor 15 through 17 has a position detecting device, such as a resolver or a similar position transducer, and these communicate with the control unit 43 via suitable signal lines 48, 49, 50. For each servo motor 15 through 17, the control unit includes a position control loop 51, 52, 53, which assures that the pivot angle assumed by the respective lever 21 through 23 corresponds to a signal value applied to a desired-value specification input 54, 55, 56.

Upon the rotation of the servo motor 15, 16, 17, or of a lever 21, 22, 23, the angle between the lever 21 through 23 and the connecting rod 34 through 36 connected to it changes. Moreover, the connecting rod 34 through 36 pivots out of its vertical orientation. Consequently, the stroke of the heddle shaft 3, 4, 5 connected is not proportional to the pivot angle of the lever 21 through 23. As a result, it also does not proportionally obey the control signal at the desired-value specification input 54 through 56. To compensate for these various nonlinearities, at least two of the position control loops 51 through 53, but preferably all three of them, are given a block 57, 58, 59 of characteristic curves, in which a characteristic curve is stored in memory that is adapted to the individual characteristic curve of the gear of the associated servo motor 15 through 17. It is defined such that it compensates for the gear characteristic curve completely, or in other words is linearized, or jointly with it produces a desired function. In this way, it can be attained that all three heddle shafts 3, 4, 5 that are connected to the servo motors 15, 16, 17 will react identically to control signals at the control inputs 61, 62, 63. The various gear kinematic situations are compensated for as a result.

The shed forming device 1 described thus far functions as follows:

In the position of repose, the heddle shafts 3 through 8 (as well as the heddle shafts 3' through 8') are in a position, as shown in FIG. 1, from which they can be deflected both upward and as needed downward. However, the position of repose may also be defined such that the heddle shafts can be deflected in only one direction, such as only upward. The levers 21 through 26 are then located preferably below the center of the circle 33 in the position of repose. The warp yarns extend essentially horizontally through the yarn eyelets 11 and are all located in a common plane. If warp yarns that extend through the heddles 9 of the heddle shaft 3 are now to be deflected out of the plane of the warp yarns, then the servo motors 15 of the servo motor groups 13, 14 are triggered accordingly. To that end, at the control input 61 (FIG. 4), they receive a signal that specifies the course of the heddle shaft 3 in terms of distance and time. This signal may be an analog signal or a digital signal. The block 57 of characteristic curves converts this distance signal into an angle signal for the servo motor 15. The control loop 51 then assures that the servo motor 15 obeys this angle signal. Accordingly, the lever 21 is pivoted as desired either downward or upward (that is, clockwise or counterclockwise). Correspondingly, the heddle shaft 3 is raised or lowered. Thus the desired shed is formed, and the weft yarn can be inserted.

The operation described can be performed in a corresponding way for all the other servo motors 16 through 20, in order to raise or lower the respective associated heddle shaft 4 through 8 and to form corresponding sheds. The triggering of the servo motors 15 through 20 is done in accordance with a predetermined pattern, so that the desired weave structure of the fabric is attained. Moreover, the operation of the servo motors 15 through 20 is synchronized with the work of the other devices in a power loom that serve the purpose of weft insertion or of beating up the weft, or for performing other operations.

Figures 5, 6:
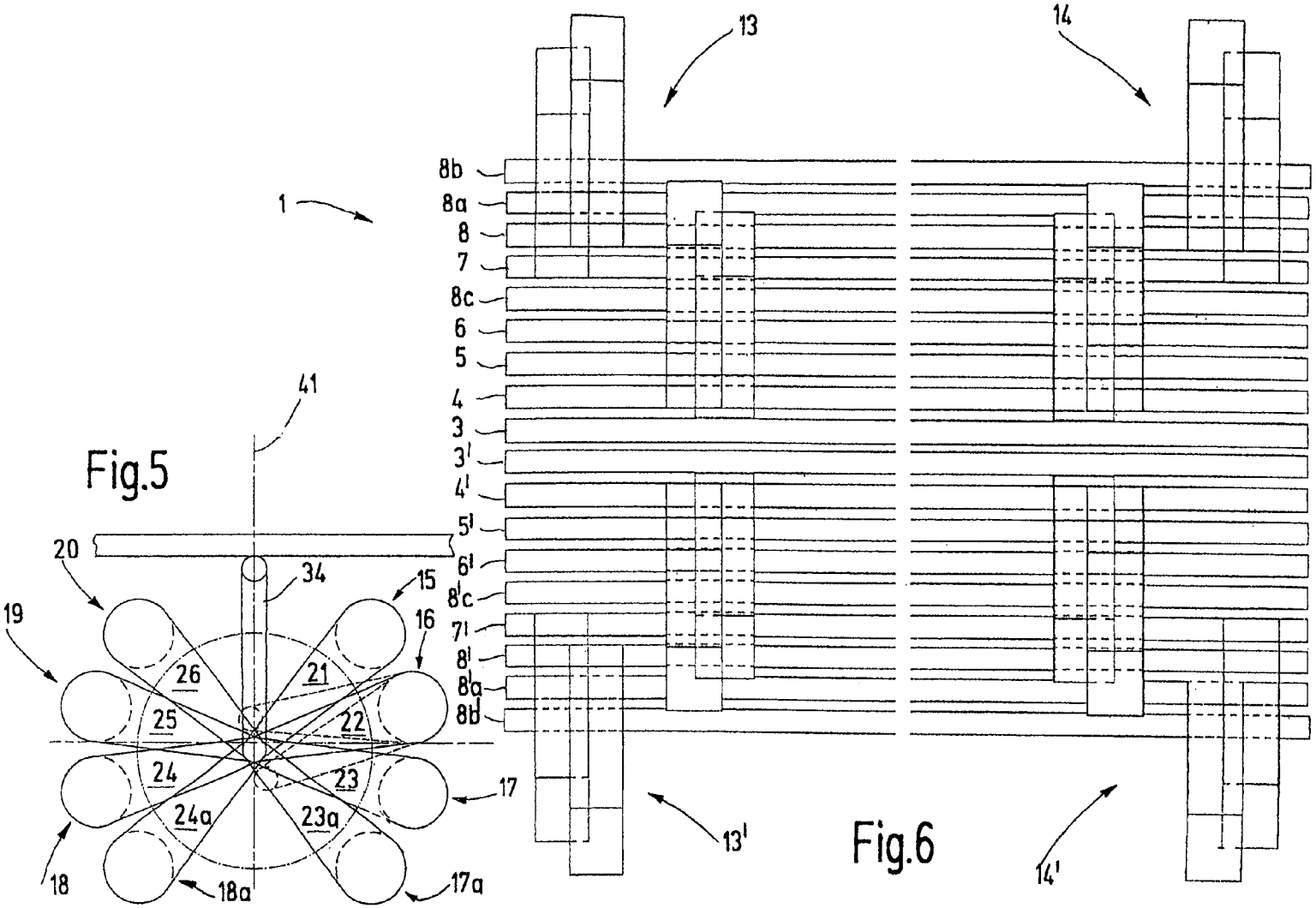
FIG. 5, a fragmentary schematic front view of a modified embodiment of the shed forming device of the invention.
FIG. 6, a top view of the shed forming device of FIG. 5.

FIGS. 5 and 6 illustrate a modified embodiment of the shed forming device 1 of the invention. It differs from the embodiment described above in the number of the moving heddle shafts 3 through 8, 8*a*, 8*b*, which here amounts to sixteen. Further heddle shafts 8*c* (8*c*') may be provided, which are supported immovably and are not assigned any drive mechanism. Once again, servo motor groups 13, 14, 13', 14' are assigned to the heddle shafts 3 through 8*b* (3' through 8*b*'), the basic construction of these groups being similar to that of the servo motor group 13, 14 of FIGS. 1 through 3. However, here each servo motor group 13, 14, 13', 14' includes eight servo motors 15, 16, 17, 17*a*, 18*a*, 18, 19, 20 each, which are arranged on an imaginary circle. Their levers 21, 22, 23, 23*a*, 24*a*, 24, 25, 26 are aimed at the center of the circle. They are joined via connecting rods to the heddle shafts 2 and are each assigned individually to these heddle shafts. The angular spacings of the servo motors 15 through 20 are not uniform. A gap is provided between the servo motors 17*a*, 18*a* and again between the servo motors 15 and 20, and this gap is substantially greater than the spacings between the other, closer-together servo motors 15 through 17*a* and 18*a* through 20. Here, as in the exemplary embodiment above, the servo motors 15 through 20 are located such that in the position of repose, none of the levers 21 through 26 forms an angle with the associated connecting rod that is less than 40?. Preferably, the angle is no less than 45?. In this way, the different transfer characteristics formed by the lever and connecting rod connection will not deviate excessively from one another and can be compensated for by the blocks 57 through 59 of characteristic curves shown in FIG. 4.

Figure 2:
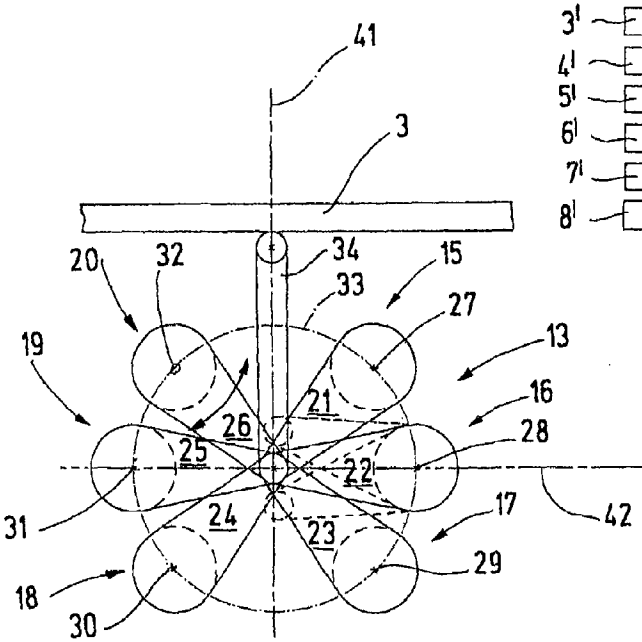
FIG. 2, a fragmentary schematic front view of the shed forming device of FIG. 1.

A further feature of the invention based on the embodiment of FIGS. 1 through 3 can be seen from FIGS. 7 and 8. Reference is made to the above description, in particular in conjunction with FIGS. 1 through 3, which applies accordingly. In addition or in a distinction, based on the same reference numerals, the following is true:

The servo motors 15 through 20 (a total of six in number) are once again, for moving the total of six heddle shafts 2 assigned to the servo motor group 13, located below these heddle shafts, but are not arranged in a circle but instead along an elliptical FIG. 33*a*. The inner ends of the levers 21 through 26, which are connected to the connecting rods 34 through 39, are located at the center of this ellipse. The ellipse 33*a* is oriented such that its long semiaxis is located on the vertical line 41. The ends of the levers 21 through 26 are preferably located in a region between the two foci of the ellipse 33*a*. The connecting rods 34 through 39 correspondingly have different connecting rod lengths. However, the differences in connecting rod length are slight. Preferably, they are less than the spacing of the foci of the ellipse 33*a*. The levers 21 through 26 are preferably each the same length. The angles formed with the connecting rods 34 through 39 are preferably not less than 45?.

The other servo motor groups 14, 13', 14' are constructed accordingly. The triggering device of FIG. 4 may be used, with the blocks 57 through 59 of characteristic curves adapted accordingly. The pivot axes 27 through 32 of the servo motors may be located either on the ellipse 33*a* or on circular arcs of suitably large diameter. However, to either side of the vertical line 41, they each define an relatively low isosceles triangle.

Figure 9:
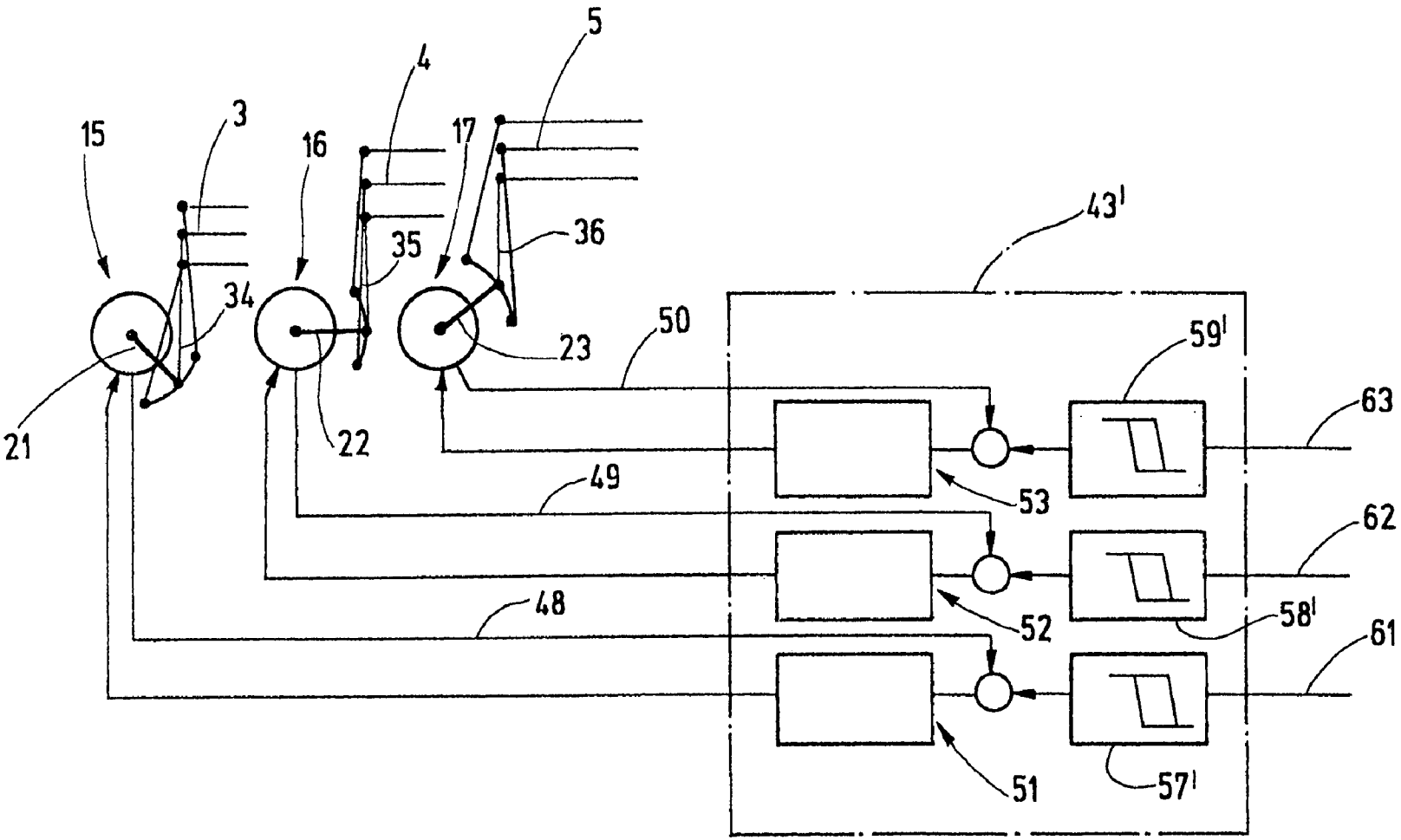
FIG. 9, a functional illustration of a modified embodiment of a shed forming device.

A further modification of the embodiments described above can pertain to the control unit 43:

FIG. 9 shows the modified control unit 43', which does not include any blocks of characteristic curves. Instead of the blocks 57 through 59 of characteristic curves, switch blocks 57' through 59' are provided, which obtain a switching signal from the commands applied to the inputs 61, 62, 63. A first value for the respective input signal corresponds to a first angle of rotation, for instance for a lower position of the respective shaft 3, 4, 5. A second value of the input signal at the control inputs 61 through 63 corresponds to a second rotary position of the respective servo motor 15 through 17 for a second position of the shaft 3, 4, 5 connected to it. The angle values are dimensioned such that in view of the gear ratio formed by the levers 21 through 23 and the connecting rods 34 through 36 connected to them, the desired working positions for each connected shaft 3, 4, 5 are attained. If the input signals at the control inputs 61 through 63 are constant, then the respective switch block 57' through 59' outputs a constant predetermined angle value, which the servo motors 15 through 17 assume. If the control signals at the control inputs 61 through 63 vary in such a way that the respective switch block 57' through 59' outputs a different predetermined angle value at its output, then the position control loops 51 through 53 immediately ascertain a corresponding control deviation and readjust the servo motors 15 through 17 as fast as possible, in order to eliminate the control deviation.

In a further modification of the control unit 43 or 43', the blocks 57 through 59 of characteristic curves, or the switch blocks 57' through 59', may also be inserted into the signal lines 48 through 50 in order to compensate for the gear nonlinearity there. All the control units 43 described may be implemented by either hardware or suitable program blocks in conjunction with a suitable computer, for instance a microcontroller.

A shed forming device 1 for a power loom has a plurality of heddle shafts, to which a drive mechanism with a plurality of servo motor groups 13, 14 is assigned. The servo motor groups are located below each of the heddle shafts 3 through 8, in each case as a cluster, and they are located with their pivot axes 27 through 32 on a circle, an ellipse, or a similar figure. They are also axially offset from one another. Each servo motor 15 through 20 is provided with a driven lever 21 through 26. The free ends of all the levers are located approximately at the center of the circle or ellipse or other figure of revolution. They are connected to the heddle shafts 3 through 8 via connecting rods 34 through 39 and form various angles with the connecting rods 34 through 39. The result is a drive mechanism with little inertia, low resilience, and little play. Very fast shaft motions can be attained in a controlled way.

It will be appreciated that the above description of the present invention is susceptible to various modifications, changes and adaptations, and the same are intended to be comprehended within the meaning and range of equivalents of the appended claims.

LIST OF REFERENCE NUMERALS

1 Shed forming device
2, 3, 4, 5, 6, 7, 8,
3', 4', 5', 6', 7', 8' heddle shafts
9 heddles
11 yarn eyelet
12 drive mechanism
13, 14, 13', 14' servo motor groups
15, 16, 17, 18, 19, 20 servo motors
21, 22, 23, 24, 25, 26 levers
27, 28, 29, 30, 31, 32 pivot axis
33 circle
33*a* ellipse

34, 35, 36, 37, 38, 39 connecting rods
41 vertical line
42 horizontal line
43 control unit
45, 46, 47 line bundles
48, 49, 50 signal lines
51, 52, 53 position control loop
54, 55, 56 desired-value specification input
57, 58, 59 blocks of characteristic curves
61, 62, 63 control inputs

What is claimed is:

1. A shed forming device (1) for a power loom, having a plurality of heddle shafts (3, 4, 5, 6, 7, 8), which are located side by side in a predetermined spacing and are supported displaceably in one direction (41) in order to be moved for shedding out of a position of repose, having a drive mechanism (12), which has a plurality of servo motors (15, 16, 17, 18, 19, 20), which are individually assigned to the heddle shafts (3, 4, 5, 6, 7, 8), and the driven shaft of each of which, rotatable about a pivot axis (27, 28, 29, 30, 31, 32), carries a respective lever (21, 22, 23, 24, 25, 26), which lever is connected to the heddle shaft (3, 4, 5, 6, 7, 8) via a connecting rod (34, 35, 36, 37, 38, 39), characterized in that the levers (21, 22, 23, 24, 25, 26), at least when the shafts (3, 4, 5, 6, 7, 8) are in the position of repose, are oriented in different directions in space and form different angles with the connecting rods (34, 35, 36, 37, 38, 39).

2. The shed forming device according to claim 1, characterized in that the servo motors (15, 16, 17, 18, 19, 20) are located one above the other in at least three planes.

3. The shed forming device according to claim 1, characterized in that the servo motors (15, 16, 17, 18, 19, 20) are offset axially from one another.

4. The shed forming device according to claim 1, characterized in that the servo motors (12, 16, 17, 18, 19, 20) form a servo motor group (13); and that the pivot axes (27, 28, 29, 30, 31, 32) of servo motors (15, 16, 17, 18, 19, 20) located one above the other define a triangle.

5. The shed forming device according to claim 1, characterized in that the servo motors (15, 16, 17, 18, 19, 20) form a servo motor group (13, 14); and that the pivot axes (27, 28, 29, 30, 31, 32) of the servo motors (15, 16, 17, 18, 19, 20) are located on a common circle (33).

6. The shed forming device according to claim 1, characterized in that the servo motors (15, 16, 17, 18, 19, 20) form a servo motor group (13, 14); and that the pivot axes (27, 28, 29, 30, 31, 32) of the servo motors (15, 16, 17, 18, 19, 20) are located on an ellipse (33*a*) standing upright.

7. The shed forming device according to claim 1, characterized in that the servo motors (15, 16, 17, 18, 19, 20) form a servo motor group (13, 14); and that the levers (21, 22, 23, 24, 25, 26) of the servo motors (15, 16, 17, 18, 19, 20) are at a common center when the heddle shafts (3, 4, 5, 6, 7, 8) are in the position of repose.

8. The shed forming device according to claim 1, characterized in that all the connecting rods (34, 35, 36, 37, 38, 39) of the drive mechanism (12) are the same length.

9. The shed forming device according to claim 1, characterized in that the connecting rods (34, 35, 36, 37, 38, 39) of the drive mechanism (12) are of different lengths, and the differences in length are less than the vertical spacings of the servo motors (15, 16, 17, 18, 19, 20) from one another.

10. The shed forming device according to claim 1, characterized in that the levers (21, 22, 23, 24, 25, 26) are all the same length.

11. The shed forming device according to claim 1, characterized in that two servo motors (15, 16, 17, 18, 19, 20) are assigned to each heddle shaft (3, 4, 5, 6, 7, 8).

12. The shed forming device according to claim 1, characterized in that the servo motors (15, 16, 17, 18, 19, 20) form at least two servo motor groups (13, 14); and that one servo motor (15, 16, 17, 18, 19, 20) from each servo motor group (13, 14) is assigned to each heddle shaft (3, 4, 5, 6, 7, 8).

13. The shed forming device according to claim 1, characterized in that the connecting rods (34, 35, 36, 37, 38, 39) are pivotably connected directly to the heddle shafts (3, 4, 5, 6, 7, 8).

14. The shed forming device according to claim 1, characterized in that the heddle shafts (3, 4, 5, 6, 7, 8) are connected rigidly to intermediate elements, on which joints for connecting the connecting rods (34, 35, 36, 37, 38, 39) are provided.

15. The shed forming device according to claim 1, characterized in that the servo motors (15, 16, 17, 18, 19, 20) are connected to a control unit (43), which is connected to a loom controller of the power loom.

16. The shed forming device according to claim 1, characterized in that the servo motors (15, 16, 17, 18, 19, 20) are connected to a control unit (43) which is part of a loom controller of the power loom.

17. The shed forming device according to claim 15, characterized in that for each servo motor (15, 16, 17, 18, 19, 20), the control unit (43) has one control input (61, 62, 63) for a control signal.

18. The shed forming device according to claim 1, characterized in that for each servo motor, the control unit (43) has one block (57, 58, 59) of characteristic curves, which represents a relationship between the angle of rotation of the servo motor (15, 16, 17, 18, 19, 20) and the distance traveled by the heddle shaft (3, 4, 5, 6, 7, 8).

19. The shed forming device according to claim 17, characterized in that the control signal is a switching signal, upon whose reception the servo motor (15, 16, 17, 18, 19, 20) is triggered such that the heddle shaft (3, 4, 5, 6, 7, 8) executes a stroke.

20. The shed forming device according to claim 19, characterized in that the shaft acceleration, shaft speed and shaft braking are adjustable.

21. The shed forming device according to claim 17, characterized in that the control signal is a guide signal, which can assume various values, and each value of the control signal corresponds to one position of the heddle shaft (3, 4, 5, 6, 7, 8).

22. A power loom with a shed forming device according to claim 1.

* * * * *